United States Patent [19]

Tsunoi

[11] 4,235,166

[45] Nov. 25, 1980

[54] FIXING APPARATUS

[75] Inventor: Haruo Tsunoi, Kawasaki, Japan

[73] Assignee: Canon Kabushiki Kaisha, Tokyo, Japan

[21] Appl. No.: 941,556

[22] Filed: Sep. 12, 1978

[30] Foreign Application Priority Data

Sep. 22, 1977 [JP] Japan ..... 52-114159

[51] Int. Cl.[3] ..... B30B 3/04

[52] U.S. Cl. ..... 100/158 R; 100/160; 118/116

[58] Field of Search ..... 100/158, 155, 162, 162 B, 100/170, 176, 160; 219/469–471, 216, 388, 244; 156/580, 582; 432/60; 355/3 FU; 101/153, 152; 118/60, 70, 101, 116; 68/257, 258

[56] References Cited

U.S. PATENT DOCUMENTS

| | | | |
|---|---|---|---|
| 2,212,820 | 8/1940 | Barber | 101/153 |
| 3,001,390 | 9/1961 | Zimmer | 100/176 X |
| 3,189,729 | 6/1965 | Lusebrink | 219/469 |
| 3,736,869 | 6/1973 | Motter et al. | 101/153 |
| 3,945,726 | 3/1976 | Ito et al. | 219/216 X |
| 4,022,122 | 5/1977 | Moser et al. | 100/158 R |
| 4,104,963 | 8/1978 | Fortman | 100/176 |

FOREIGN PATENT DOCUMENTS 51-40351 of 1976 Japan .

*Primary Examiner*—Philip R. Coe

*Attorney, Agent, or Firm*—Fitzpatrick, Cella, Harper & Scinto

[57] ABSTRACT

Apparatus for fixing a toner image on a toner image supporting member in an electrophotographic copying machine is disclosed. The fixing apparatus comprises three rotary rollers which are in contact with each other under the action of pressing means. One of the three rollers has a smaller diameter than the remaining two rollers. In order to press the toner image supporting member uniformly between the two rollers with which the supporting member comes into contact, the two rollers are disposed in such a manner that the roller axes cross one another.

10 Claims, 8 Drawing Figures

FIXING APPARATUS

BACKGROUND OF THE INVENTION

1. Field of the Invention

The present invention relates to a fixing apparatus for use in an electrostatic copying machine, electrostatic printing machine and the like.

2. Description of the Prior Art

Hitherto, a heat fixing process has been used most widely in electrophotographic copying or printing machines. According to the heat fixing process, a toner image electrostatically adhered to the surface of a supporting member such as a sheet of paper is fused with heat to permanently fix the toner image on the supporting member.

However, it has been found that such heat fixing method has various drawbacks. Firstly, it needs a large quantity of electric power for the heat source. The quantity of electric power consumed in this heat fixing station reaches about 70–80% of the total power consumption by the whole copying machine. Secondly, it takes a relatively long time to warm up the fixing apparatus. Therefore, it is impossible to start a copying operation immediately after the power source of the copying machine is switched on. Lastly, heat emitted from the fixing apparatus has adverse effects on the characteristics of the photosensitive medium and/or developer. The whole copying machine suffers from the heat emitted from the fixing apparatus and there occurs change in characteristics of the photosensitive medium and/or developer which in turn reduces the efficiency and effective life thereof. In the worst case, there may occur a serious problem if the supporting member catches fire when it becomes jammed in the fixing apparatus.

Due to the above mentioned drawbacks involved in the heat fixing method, nowdays there is an increased tendency to use the pressure fixing method instead of heat fixing method. According to the pressure fixing method, toner particularly prepared for pressure fixing method is adhered onto a supporting member to form a toner image and the supporting member carrying thereon the toner image is passed through between a pair of rollers contacting with each other under a high pressure so as to fix the toner image with pressure.

A typical example of pressure fixing apparatus according to the prior art is shown in FIG. 1. Designated by P is a supporting member carrying thereon a toner image. Fixing of the toner image is effected between a pair of rollers 1 and 2 under pressure. The necessary pressure is given by a pressing mechanism 3 which brings the two rollers 1 and 2 into contact with each other under a high pressure. One of the rollers which contacts with the image side surface of the supporting member P, that is, the roller 1 is made of metal. The other roll which contacts with the backside surface of the supporting member P, that is, the roller 2 is made as an elastic roller by covering the surface of the roller with elastic material. As an alternative, both of the rollers 1 and 2 may be made as rigid metal rollers. In this case, the two metal rollers 1 and 2 are disposed in such manner that the one roller intersects the other.

The pressure fixing apparatus comprising a metal roller and an elastic roller has the disadvantage that the maximum pressure which the fixing rollers can apply to the toner image supporting member is limited by the kind of material used for the elastic roller. Therefore, it is unallowable to apply a high pressure to this type of the fixing rollers. Moreover, the elastic roller is easily damaged by toner and carrier.

For the latter mentioned type of pressure fixing apparatus comprising two rigid metal rollers, it is allowed to apply a high contact pressure. Nevertheless, it has some drawbacks in practical use. The fixing roller is required to have a larger diameter in order to apply onto the surface of supporting member a load (pressure) more than the critical pressure necessary for sufficiently fixing the toner image. When this requirement is satisfied, the apparatus inevitably becomes large in size and heavy in weight as a whole. This will also have an unfavourable effect on the fixability of the toner image. Moreover, if the two metal rollers which must be arranged to intersect each other as previously noted have different diameters, then there will arise a problem of creasing in the supporting member. This problem of creasing becomes remarkable in particular when a supporting member of larger size in width is used.

I, the inventor of the present invention have carried out a number of experiments on the pressure fixing apparatus. These inventive experiments have led us to find that an important factor affecting the pressure fixability of a toner image is the maximum pressure per unit area ($P_o$) rather than the total pressure exerted on the nip portion between the pair of rollers ($W_o$). In other words, it has been found that the local maximum pressure $P_o$ has a greater effect on the pressure flexibility of toner image than the total pressure $W_o$ does.

As seen in FIG. 2, the conventional pressure fixing apparatus can not produce a high local maximum pressure $P_o$ even when the total pressure $W_o$ is increased. The rollers 1 and 2 shown in FIG. 2 have a larger diameter $R_o$. A toner image supporting member P is nipped in between the two rollers and there is formed a nip width (angle $\alpha$). As will be easily understood, the nip width will become broader with the increase of the roller diameter $R_o$. Therefore, the increase of the total pressure $W_o$ can not bring about the corresponding increase of the value of $P_o$ (maximum pressure per unit area). The increase of the value $P_o$ is relatively small or the value of $P_o$ remains unchanged as compared with the increase of the total pressure $W_o$. For this reason, in case of the conventional pressure fixing apparatus, no substantial improvement in pressure fixability can be attained by increasing the total pressure $W_o$.

SUMMARY OF THE INVENTION

Accordingly, it is a general object of the present invention to eliminate the above mentioned disadvantages and drawbacks involved in the pressure fixing apparatus according to the prior art.

More specifically, it is an object of the invention provide a fixing apparatus which enables the application of a higher load onto a toner image supporting member.

It is another object of the invention to provide a fixing apparatus which enables improvement of the fixability of toner image in proportion to the increase of total pressure and which is small in size and light in weight.

It is a further object of the invention to provide a fixing apparatus which assures a uniform application of pressure on a toner image supporting member while preventing crease formation in the supporting member and which permits a stable transportation of the supporting member.

A still further object of the invention is to provide a fixing apparatus which can prevent the roller from slipping out from its proper position and from being damaged thereby.

Other and further objects, features and advantages of the invention will appear more fully from the following description taken in connection with the accompanying drawings.

DESCRIPTION OF THE PREFERRED EMBODIMENTS

Figure 3:
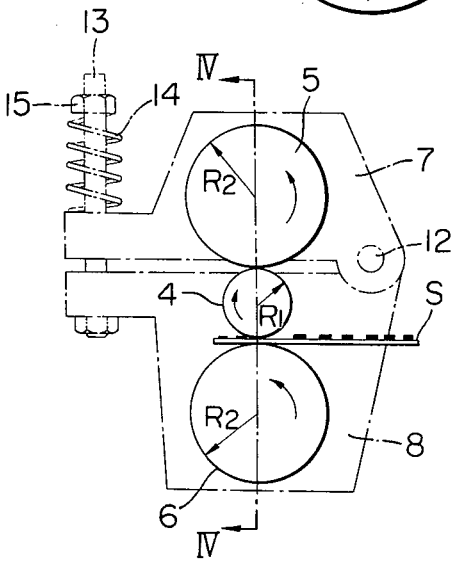
FIG. 3 shows an embodiment of a fixing apparatus according to the invention.

The fixing apparatus according to the invention shown in FIG. 3 comprises three rollers, a first roller 4 and two pressing rollers 5 and 6 being in contact with the first roller 4. These rollers are made of hard metal such as iron and the two pressing rollers 5 and 6 have a larger diameter than the first roller 4. The diameter of the roller 5 may be equal to or different from that of the other pressing roller 6. But, when these two pressing rollers are the same in both material and structure to each other, they preferably have an equal diameter. Two pressing rollers of equal diameter can be deflected in an equal degree when an equally distributed load is applied to the supporting member. Therefore, the pressing rollers 5 and 6 can be disposed symmetrically relative to the axis of the first roller 4 and in contact with the surface of the roller 4 uniformly while keeping the axis of the roller 4 straight.

Figure 4:
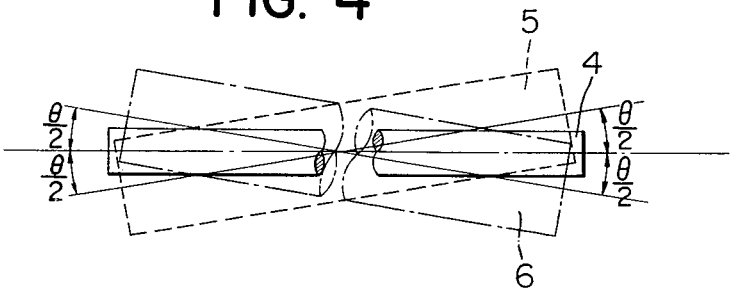
FIG. 4 is an illustration explaining the manner by which the first roller contacts with the upper pressing roller and the lower pressing roller.
Figure 6:
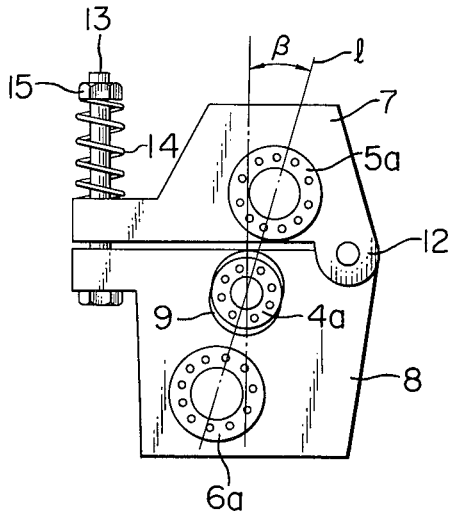
FIG. 6 is a side view thereof.

The arrangement of three rollers 4, 5 and 6 are shown in FIGS. 4 and 6. Relative to the first roller 4, two pressing rollers 5 and 6 are disposed in such a manner that the axes of the pressing rollers 5 and 6 intersect the axis of the first roller 4 and that the binding line passing through the three centers of the rollers 4, 5 and 6 always form a straight line in any cross section thereof. Thus, in FIG. 4, the axes of the two pressing rollers 5 and 6 intersect the axis of the first roller 4 at an angle of $\theta/2$ respectively and in FIG. 6 all the centers a, b and c of the three rollers 4, 5 and 6 lie on a straight line l.

While in the above described embodiment the first roller 4 and the lower pressing roller 6 with which the supporting member S comes into contact are shown to be in direct contact with each other, the first roller and the lower pressing roller may be spaced from each other slightly to form a gap therebetween so that these two rollers 4 and 6 can contact with each other indirectly through the supporting member S.

Figure 5:
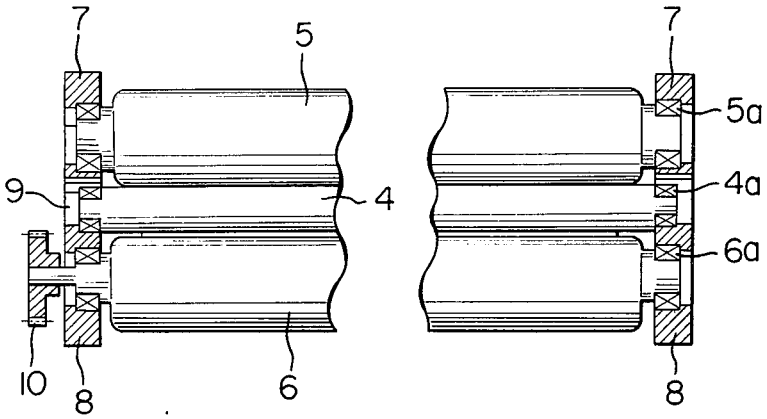
FIG. 5 is a vertical section of the apparatus shown in FIG. 3 taken along the axes of the rollers.

As seen best in FIGS. 5 and 6, the upper pressing roller 5 is rotatably mounted on a pair of upper supporting plates 7 through a bearing 5*a* and the lower pressing roller 6 is rotatably mounted on a pair of lower supporting plates 8 through a bearing 6*a*. The first roller 4 is mounted on the lower supporting plate 8 rotatably through a bearing 4*a*. As already described, these three rollers are so positioned that under pressure three centers of these roller in any cross section thereof may always lie on one and the same straight line.

The above described arrangement of three rollers brings forth particular advantages. Since the line binding the three centers of the rollers 4, 5, 6 forms a straight line, the load on the supporting member S can be distributed uniformly over the surface. Moreover, when the first roller 4 is sandwiched in between the two pressing rollers 5 and 6, the above described feature of the arrangement effectively serves to prevent the first roller 4 from slipping out from its position or being bent by shock at the time when the toner image supporting member S comes in or comes out from the roller.

In order to make it possible to apply onto the supporting member S an equally distributed load without failure, the first roller 4 mounted on the supporting plate 8 is movable slightly also in the direction parallel to the straight line l. To this end, as seen in FIGS. 5 and 6, the lower supporting plate 8 has an opening 9 passing through the plate in the direction of the straight line l. The bearing 4*a* for the first roller is received within the opening 9 and slightly movable in the direction of the straight line l within it.

The toner image supporting member S which may be a sheet of paper having a toner image thereon is fed into the nip between the first roller 4 and the lower pressing roller 6 with its toner image side being in contact with the first roller.

At the one end of the axis of the lower pressing roller 6 there is provided a driving gear 10 (FIG. 5) operatively connected to a driving source. When the driving gear 10 is driven by a motor, the pressing roller 6 rotates and therefore the rollers 4 and 5 are also driven into rotation through the pressing roller 6. The driving gear may be provided at the one end of the first roller 4 alternatively.

The two supporting plates 7 and 8 are supported by a common shaft 12 and pivotally movable about the shaft. The free end of the supporting plates has a bore through which a bolt 13 passes. A coil spring 14 is disposed around the bolt 13 on which a nut 15 is screwed. The spring force of the coil spring 14 can be adjusted by screwing in or out the nut 15 on the bolt 13. Bolt 13, spring 14 and nut 15 constitute a pressing mechanism for bringing the rollers into pressure contact with each other. When the upper and lower supporting plates 7 and 8 are moved coming near to each other up to a closed position by the pressing mechanism as shown in FIG. 6, the three rollers 4, 5 and 6 are brought into a pressure contact relation. In this position, the gear 10 is driven to rotate the rollers and a toner image supporting member S is fed into the nip portion between the rollers 4 and 5 so as to fix the toner image on the supporting member. As described above, the contact pressure between these rollers is adjustable by means of the nut 15.

Figure 7:
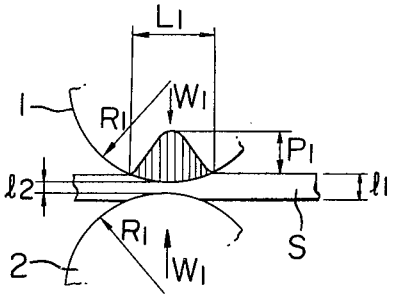
FIG. 7 shows the distribution of pressure applied to the apparatus shown in FIG. 1.
Figure 8:
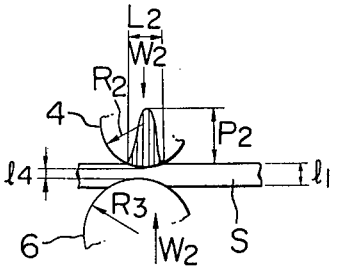
FIG. 8 shows the distribution of pressure applied to the apparatus shown in FIG. 3.

Now, referring to FIGS. 7 and 8, the effect of the present invention is described.

As previously noted, an important factor which affects the pressure fixability of toner image is the local maximum pressure per unit area at the nip portion rather than the total pressure exerting on the rollers. To demonstrate the effect of the invention, the nip width and the maximum pressure at the nip portion were measured by experiment and calculation using the fixing apparatus shown in FIG. 3. The result is shown in FIG. 8. For the purpose of comparison, similar experiment and calculation were conducted using the fixing apparatus according to the prior art shown in FIG. 1. The result is shown in FIG. 7 similarly. For calculation, the following equation was employed:

$$P\max = 0.6\sqrt{WE/R}$$

wherein, W is linear pressure, E is the elastic modulus of the toner image supporting member in the longitudinal direction and R is the radius of the roller.

Figure 1:
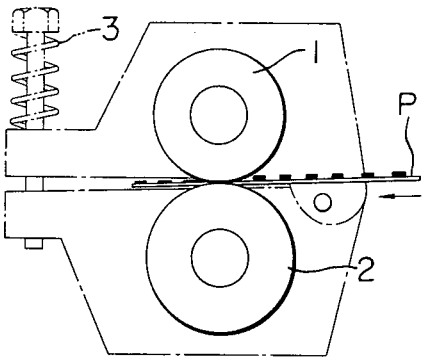
FIG. 1 PRIOR ART
FIG. 1 is a schematic view of a fixing device according to the prior art.
Figure 2:
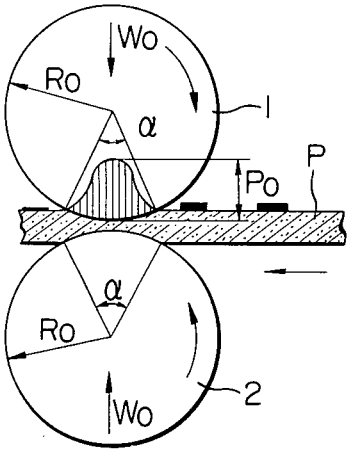
FIG. 2 PRIOR ART
FIG. 2 is an illustration explaining the pressure applied to a fixing device according to the prior art.

As the toner image supporting member S, copy papers of the same kind were used for both of the apparatus of FIG. 1 and the apparatus of FIG. 3. Also, the same toner, rollers made of the same hard metal material and the same copy paper feeding speed were used for the experiments.

In FIG. 7, the radius $R_1$ of each of the rollers 1 and 2 was 30 mm, the total pressure $W_1$ was 40 Kg/cm$^2$ (as linear pressure), the thickness of copy paper before pressing $l_1$ was 80$\mu$ and the thickness during pressing $l_2$ was 30$\mu$. Under these conditions, the nip width (that is the width of the deformed portion of the copy paper nipped between the two rollers) $L_1$ was found to be 2.2 mm and the local maximum pressure $P_1$ was found to be 220 Kg/cm$^2$.

In contrast with the above, in case of the present invention shown in FIG. 8 there was found that the nip width $L_2$ was 1.3 mm and the local maximum pressure $P_2$ was 270 Kg/cm$^2$ under the conditions of the radius $R_2$ of the first roller 4=10 mm, the radius $R_3$ of each of the pressing rollers 5 and 6=20 mm, the total pressure $W_2$=20 Kg/cm$^2$ (linear pressure) and the thickness of copy paper during pressing $l_3$=30$\mu$.

It is evident from the above results that the fixing apparatus according to the invention enables to apply a larger load onto the supporting member with a smaller total pressure as compared with the prior art apparatus and therefore a better fixability can be obtained with the apparatus according to the invention.

In the above described experiments, it was also found that the thickness of copy paper was reduced to 60$\mu$ when measured immediately after pressure fixing for the prior art apparatus whereas the thickness of copy paper for the apparatus according to the invention was 65$\mu$. This difference is attributable to the difference of nip width. As described above, the nip width in the apparatus according to the invention was 1.3 mm whereas that in the prior art one was 2.2 mm. The nip width in the former is smaller by 40% than that in the latter. Therefore, for the same transportation speed of copy paper, the time during which pressure is applied onto the copy paper is shortened with the apparatus according to the invention. This in turn serves to lessen the changes in quality of copy paper usually caused by high pressure during pressure fixing such as loss of elasticity of fiber and sticking together of fibers in the paper. In this manner, when pressure fixing is carried out with the fixing apparatus according to the invention, the copy paper after fixing can maintain its resiliency, good surface appearance and softness. Contrary to the case of conventional pressure fixing, the copy paper never becomes brightened or translucent and therefore the fixed image on the copy paper is easy to see.

As will be seen from the foregoing, the fixing apparatus according to the invention has various advantages as compared with the conventional ones. The use of the first roller sandwiched in between the two pressing rollers and having a smaller diameter than those of the pressing rollers produces a higher maximum pressure per unit area and serves to apply a larger load onto a toner image supporting member. Since a higher local maximum pressure can be produced, the size of each roller can be reduced accordingly. Since the total pressure applied to each roller can be of lower level, the size of the pressing mechanism can be reduced accordingly. Thus, the fixing apparatus according to the invention is small in size and light in weight. Compared with the conventional apparatus, reduction of weight of 40% is easily attainable according to the invention. By disposing at least two rollers which together forms a nip for the supporting member, that is, the first roller and any one of pressing rollers intersecting each other, a uniform pressure contact is assured between the two rollers. This prevents the supporting member being creased during fixing and also it prevents irregular fixing. Further, by disposing three rollers intersecting each other in such manner that the centers of the three rollers may lie on a straight line, it is assured to press the toner image supporting member uniformly. This feature of arrangement also has an effect to prevent the first roller under contact pressure from slipping out from its position or being damaged by the shock at the time when the supporting member comes into or comes out from the roller.

While the invention has been particularly shown and described with reference to preferred embodiments thereof, it will be understood by those skilled in the art that the foregoing and other changes in form and details can be made therein without departing from the spirit and scope of the invention.

What I claim is:

1. A pressure fixing device wherein a toner image on a surface of a toner image bearing member is fixed thereon by pressure, comprising:

first and second rollers for pressing and conveying an image bearing member therebetween; and a third roller press-contacted to said first roller;

wherein each of said first, second and third rollers is made of a material suitable for applying sufficient pressure to the image bearing member to fix the image thereon;

wherein said first roller is positioned between said second and third rollers and has a diameter smaller than the diameters of said second and third rollers; and wherein said three rollers are so arranged that, when no pressure for fixing the image is applied, said second roller and said third roller have their axes at angles with respect to the axis of said first roller which are measured in opposite directions, as viewed when facing the surface of the image bearing member.

2. Apparatus as claimed in claim 1, wherein said first roller is movable relative to said second and third rollers such that said centers substantially remain rectilinear.

3. Apparatus as claimed in claim 1, wherein said first, second and third rollers are supported in direct contact with each other and are pressed against each other by a pressing means.

4. Apparatus as claimed in claim 1, wherein said first roller is in direct contact with said third roller and said first roller and second rollers are spaced from each other to form a gap therebetween so that said first and second rollers contact each other indirectly through the image bearing member.

5. A device according to claim 1, wherein said first, second and third rollers are made of hard metal.

6. A device according to claim 5, wherein said second and third rollers are made of the same material and have the same diameter.

7. A pressure fixing device wherein a toner image on a surface of a toner image bearing member is fixed thereon by pressure, comprising:

first and second rollers for pressing and conveying an image bearing member therebetween; and a third roller press-contacted to said first roller;

wherein said three rollers are so arranged that, when no pressure for fixing the image is being applied, at least two of said first, second and third rollers have their axes at angles with the conveyance direction of the image bearing member which are different from each other and different from the angle formed between the conveyance direction and the axis of the other roller, as viewed when facing the surface of the image bearing member, and wherein the centers of said first, second and third rollers, at any cross section, are substantially rectilinearly arranged.

8. A device according to claim 7, wherein said first, second and third rollers are made of hard material.

9. A pressure fixing device wherein a toner image on a surface of a toner image bearing member is fixed thereon by pressure, comprising:

first and second rollers for pressing and conveying an image bearing member therebetween; and a third roller press-contacted to said first roller;

wherein each of said first, second and third rollers is made of a material suitable for applying sufficient pressure to the image bearing member to fix the image thereon;

wherein said first roller is located between said second and third rollers and has a diameter smaller than that of said second roller; and wherein said three rollers are so arranged that, when no pressure for fixing the image is applied, at least two of said rollers have their axes at angles with the conveyance direction of the image bearing member which angles are different from each other, as viewed when facing the surface of the image bearing member.

10. A device according to claim 9, wherein the surface of the image bearing member which has the toner image thereon is contacted with said first roller.

* * * * *